United States Patent [19]

Palka

[11] 4,047,016

[45] Sept. 6, 1977

[54] BATHROOM CABINET LIGHTING FIXTURE

[75] Inventor: James J. Palka, Arlington Heights, Ill.

[73] Assignee: General Bathroom Products Corporation, Elk Grove Village, Ill.

[21] Appl. No.: 686,675

[22] Filed: May 14, 1976

[51] Int. Cl.[2] ..... F21V 33/00

[52] U.S. Cl. ..... 240/4; 240/4.1; 312/223

[58] Field of Search ..... 240/2 R, 2 BV, 2 D, 240/4 R, 4.1, 4.2, 6; 312/204, 223, 224, 225, 236, 245

[56] References Cited

U.S. PATENT DOCUMENTS

| | | | |
|---|---|---|---|
| 1,952,314 | 3/1934 | Henkel | 240/4.1 |
| 2,876,056 | 3/1959 | Berger | 312/223 |
| 2,927,198 | 3/1960 | Trott | 312/223 X |
| 3,038,771 | 6/1962 | Schwartz et al. | 312/223 |
| 3,320,413 | 5/1967 | Mansson | 240/4 |
| 3,737,646 | 6/1973 | Burrows | 240/4.2 |

*Primary Examiner*—L. T. Hix
*Assistant Examiner*—Alan Mathews
*Attorney, Agent, or Firm*—W. A. Snow

[57] ABSTRACT

This invention relates to lighting fixtures for bathroom cabinets wherein incandescent bulbs are employed in the fixtures and comprises a pair of opposed arms secured to the cabinet body and terminating in a forwardly direction on the sides of the cabinet and having an upwardly extending portion and cup.

2 Claims, 6 Drawing Figures

FIG. 1
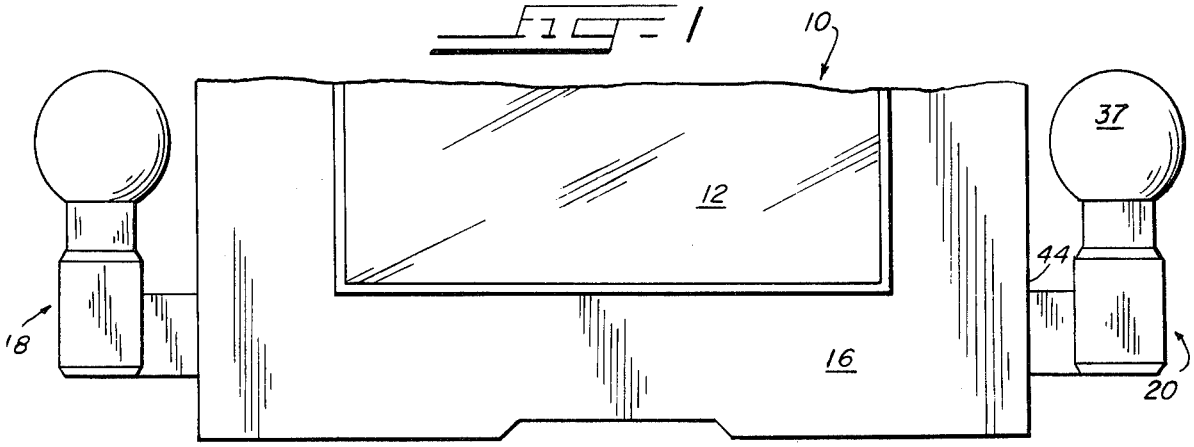
FIG. 2
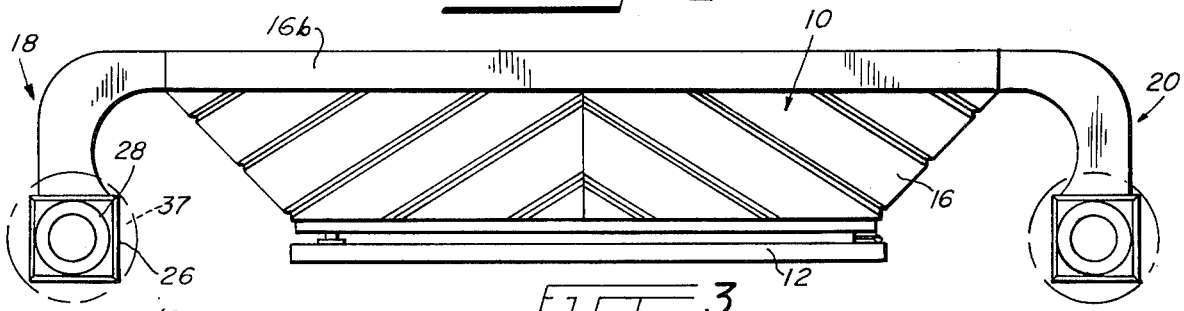
FIG. 3
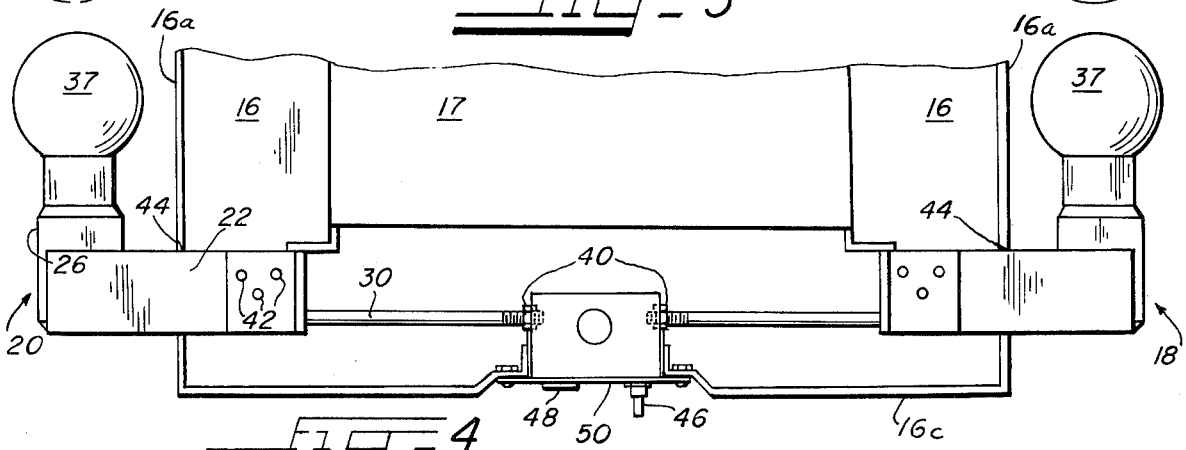
FIG. 4
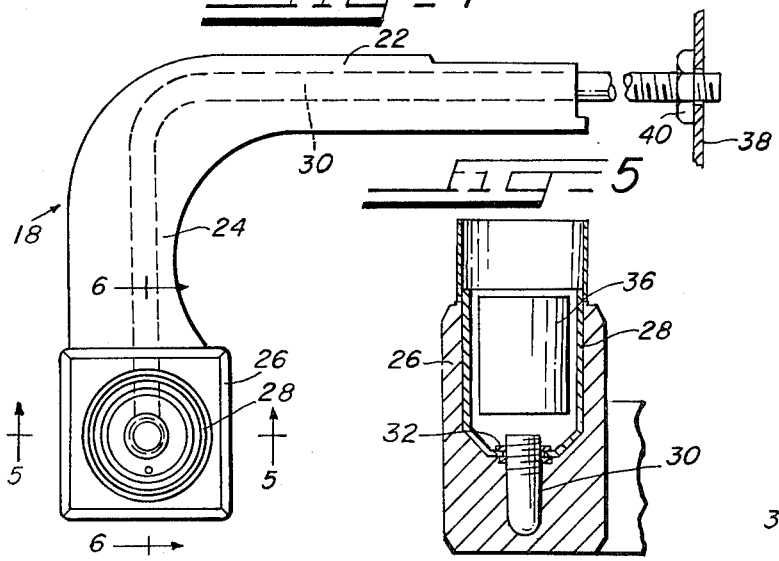
FIG. 5
FIG. 6
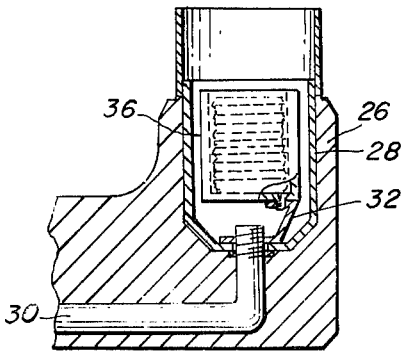

BATHROOM CABINET LIGHTING FIXTURE

BACKGROUND OF THE INVENTION

Lights associated with bathroom cabinets normally have integral fixtures associated therewith of the fluorescent type arranged on the side walls of the cabinet. Others have fluorescent fixtures integrally arranged on the top wall of the cabinet and in both cases, the fixtures are usually provided with light deflectors.

SUMMARY OF THE INVENTION

A pair of opposed light arm brackets secured to the cabinet body adjacent the lower end thereof and extending outwardly and forwardly and terminating in a cup, said arms secured together in end-to-end relationship and secured to an outlet box.

BRIEF DESCRIPTION OF THE DRAWINGS

FIG. 1 is a front elevational view of a bathroom cabinet on which the light arms of the present invention are incorporated, with parts broken away;

FIG. 2 is a top elevational view of FIG. 1;

FIG. 3 is a rear elevational view thereof, with parts broken away;

FIG. 4 is a top elevational view of one of the light arms incorporating the wire tubing, with hickey and lamp socket removed;

FIG. 5 is a cross-sectional view taken on the lines 5—5 of FIG. 4, with parts broken away; and FIG. 6 is a cross-sectional view taken on the lines 6—6 of FIG. 4, with parts broken away and parts added.

DETAILED DESCRIPTION OF THE DRAWINGS

The cabinet 10 is provided with a mirrored door 12, and outwardly tapered ornamental framing 16, all molded in one piece, with the usual body 17 and shelving (not shown), the margins of said framing having rearwardly extending flanges forming side, top and bottom walls **16*a*, 16*b* and 16*c***, respectively.

The two arms 18, 20 are identical in configuration and content but one is the mirror image of the other, hence right and left hand arms, thus the following description will be directed to one arm only.

The arm 18 is plastic molded and has a horizontal portion 22 and a right angled portion 24 on a radius of about 1 ⅝inches, terminating in rectangular portion 26. The portion 26 is provided with a cylindrical bore for the reception of a metal cup 28.

An elongated conduit 30 is molded in the arm 18 and one end terminated in and partially through the lower end of the metal cup 28. This end is threaded to receive one end of the lamp socket threaded hickey 32. The lamp socket 36 and its outer nonconductive shell is secured to the upper end of the hickey 32 to suspend the usual lamp socket axially in said cup 28, and receive the incandescent lamp 37.

The other end of the conduit is also threaded and extends partially into the electric box 38 and is secured thereto by nut 40.

The arm is secured to the rear of the framing by screws 42 and into appropriate and customary supporting members, not shown, whereby the arm is anchored solidly.

The flanges of the frame 16 are provided with appropriate cutouts 44 in the side walls **16*b*** to receive the respective arms.

The electric wiring is usual and customary from the source to the box 30 and thence to the lamp sockets 36 through conduit 30. The electric box 38 is secured to the bottom wall **16*c* and may be provided with an on-off switch 46 and a convenience outlet 48 appropriately positioned on cover plate 50** and incorporated in the electric wiring as customary.

Although but one specific embodiment of this invention is herein shown and described, it will be understood that details of the construction shown may be altered or omitted without departing from the spirit of the invention as defined by the following claims.

I claim:

1. Side lighting arm fixtures for cabinets used in bathrooms and mounted on a wall, said cabinets comprising a one piece, molded plastic cabinet body with ornamental hollow framing therearound having depending rearwardly extending flanges on the margin of said framing forming top, side and bottom walls, said side walls having cutouts adjacent the bottom wall, in combination with a pair of light arm brackets, each comprising a one piece, plastic molded, elongated horizontal portion and a right angled portion, an elongated rectangular portion formed on the terminal end of said latter portion extending vertically, said rectangular portion having a cylindrical bore therein, a cable conduit molded in said bracket with one end terminating in said bore, an electrical lamp socket secured at one end in said bore, an electric box secured to said bottom wall of the said framing, said other end of said conduits secured to said box, and means for fastening said horizontal portions to said framing adjacent the lower end of said cabinet.

2. The device according to claim 1 wherein an elongated metal cup is secured in said bore and has an aperture in which one end of said conduit partially extends and is secured to thereto.

* * * * *